US006593536B1

(12) United States Patent
Karasik

(10) Patent No.: US 6,593,536 B1
(45) Date of Patent: Jul. 15, 2003

(54) MULTI-AXIS SWITCH WITH REDUNDANT CONTACTS

(75) Inventor: Boris G Karasik, Commerce Township, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 10/153,499

(22) Filed: May 21, 2002

(51) Int. Cl.[7] ..... H01H 19/00
(52) U.S. Cl. ..... 200/6 A; 200/17 R
(58) Field of Search ..... 200/6 A, 6 R, 200/6 BA, 16 A, 16 B, 16 C, 4, 17 R, 18, 335, 332

(56) References Cited

U.S. PATENT DOCUMENTS 2,857,485 A * 10/1958 Brooks ..... 200/6 A
3,818,154 A * 6/1974 Presentey ..... 200/6 A
3,827,313 A * 8/1974 Kiessling ..... 74/471 XY
3,828,148 A * 8/1974 Roeser ..... 200/6 A
4,301,338 A * 11/1981 McMurtry ..... 200/61.41
4,520,242 A * 5/1985 Kopsho, Jr. ..... 200/6 A
4,533,899 A * 8/1985 Isaksson ..... 338/128
6,046,415 A 4/2000 Briski
6,359,613 B1 3/2002 Poole
2002/0003082 A1 1/2002 Janniere et al.

* cited by examiner

*Primary Examiner*—Elvin Enad
*Assistant Examiner*—Lisa N Klaus
(74) *Attorney, Agent, or Firm*—Edwin W. Bacon, Jr.

(57) ABSTRACT

An electrical switch having redundant circuits, where the switch has a pivotable plunger having an arcuate conductive bearing and a contact tip. The plunger bearing is electrically connected to the contact tip and is supported on a conductive substrate. When the plunger is pivoted from a first to a second position, the contact tip closes a first circuit between the substrate and a first contact and closes a second, redundant, circuit between the substrate and a second contact.

20 Claims, 3 Drawing Sheets

MULTI-AXIS SWITCH WITH REDUNDANT CONTACTS

FIELD OF THE INVENTION

This invention relates generally to switches for making and breaking electrical circuits. More particularly, this invention relates to switches for simultaneously making and breaking a redundant pair of circuits.

DESCRIPTION OF THE RELATED ART

In some electrical circuits, it is desirable to provide redundantly switched circuits for control signals. The redundant circuit provides a greater degree of certainty that the switch was closed or opened intentionally and not by a failure mechanism, such as a short circuit.

One possible application of a redundant circuit is a speed control switch for a vehicle. The speed control switch provides, for example, control information to turn the speed control system on and off and to accelerate and decelerate the vehicle. It is important that in addition to providing redundant circuits, the switch positions also be tactile and that the switch mechanism itself be durable to withstand the physical stresses of use.

As is generally known, the vehicle manufacturing business is particularly competitive and highly automated. It is thus also desirable that the design for a redundant switch be inexpensive to produce and easily adapted to automated assembly.

BRIEF SUMMARY OF THE INVENTION

Accordingly, one aspect of the present invention is to provide a tactile switch with redundant circuits.

Another aspect of the present invention is to provide a switch having redundant circuits that is durable and inexpensive to manufacture when compared with similar state of the art redundant switches.

In accordance with these aspects of the invention, an electrical switch is provided having redundant circuits. The switch has a pivotable plunger having an arcuate conductive bearing and a contact tip. The plunger bearing is electrically connected to the contact tip and is supported on a conductive substrate. When the plunger is pivoted from a first to a second position, the contact tip closes a first circuit between the substrate and a first contact and closes a second, redundant, circuit between the substrate and a second contact.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

DETAILED DESCRIPTION OF THE INVENTION

Figure 1:
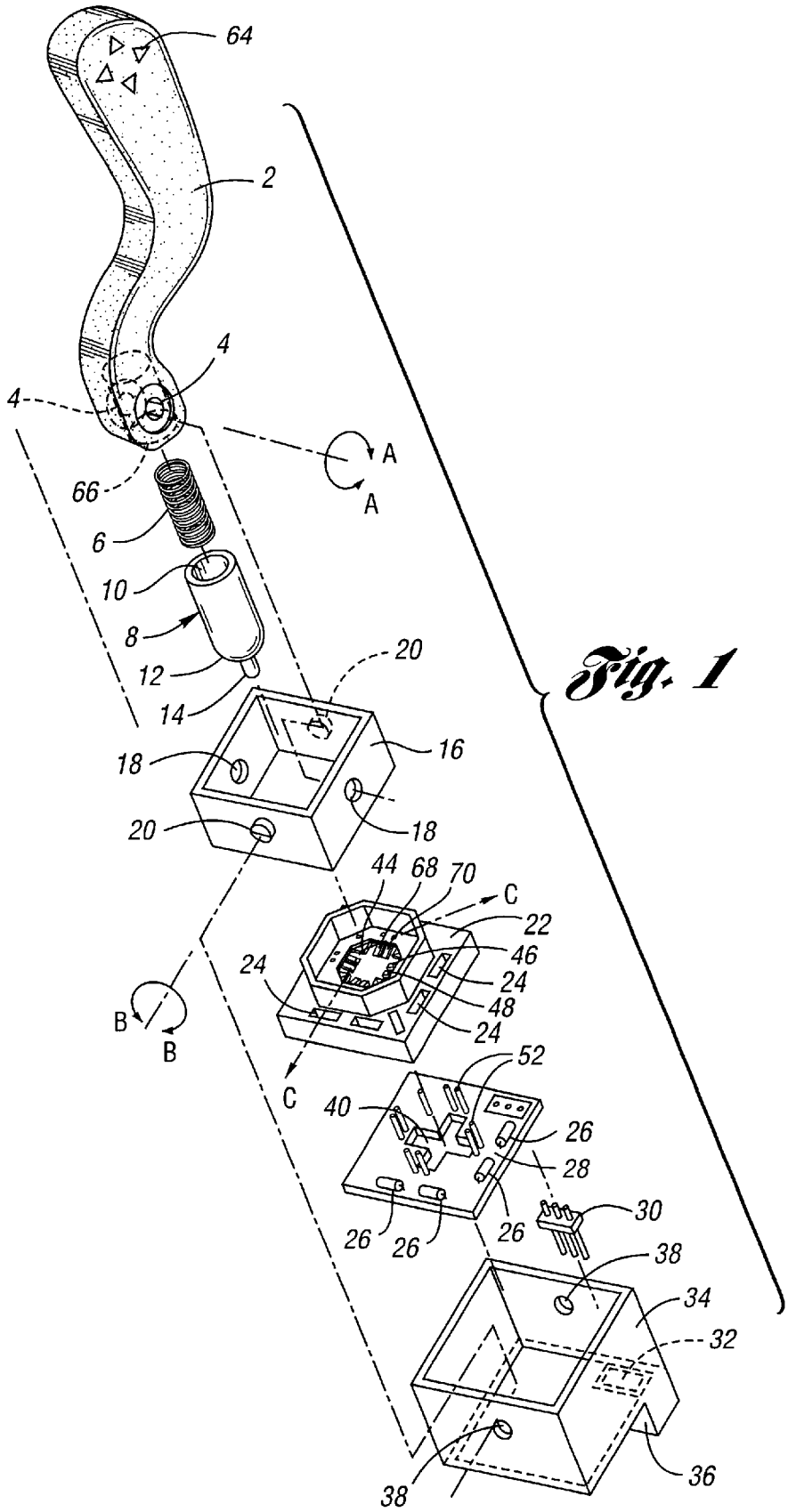
FIG. 1 shows an exploded view of a switch in accordance with the present invention.

Turning to FIG. 1, a switch is shown in accordance with the present invention. The switch has a lever 2 for actuation by a user. The lever 2 may have indicia 64 indicating the function of the switch. At an end of the lever 2 is a lever pin 4 arranged normal to a longitudinal axis of the lever 2. A plunger receiver 66 is formed into the same end of the lever 2, with the length of the plunger receiver 66 being approximately centered on the longitudinal axis of the lever 2.

A plunger 8 has a spring receiver 10 for receiving a detent spring 6. When uncompressed, an end of the detent spring 6 protrudes from the spring receiver 10. An arcuate plunger bearing 12 is arranged normal to the longitudinal axis of the plunger 8 and preferably extends around the circumference of the plunger 8. The arcuate surface of the plunger bearing transitions into a contact tip 14, which extends outwardly away from the spring receiver 10 and along the longitudinal axis of the plunger 8.

The plunger bearing 12 and the contact tip 14 are both conductive and electrically connected to each other. This is preferably accomplished by constructing the plunger 8 from a single piece of metal. The metal should be amenable to being formed into the plunger 8 shape and have sufficient strength to prevent the contact tip 14 from breaking. Silver-coated brass is a satisfactory material.

The spring receiver 10 end of the plunger slip-fits into the plunger receiver of the lever 2, with the protruding end of the spring 6 pressing against the interior surface of the plunger receiver 66. When the detent spring 6 is compressed, it operates to urge the plunger 8 in a direction away from plunger receiver 66.

The bearing surface 12 is continuously urged against a conductive substrate 42 by the detent spring 6. Referring briefly to FIG. 2*b*, the substrate 42 is shown in detail. The plunger bearing 12 is in constant contact with substrate bearings 44, which are evenly and radially spaced about the substrate 42. A common electrical circuit is thus created between the substrate bearings 44, the plunger bearing 12 and contact tip 14. With the lever 2 in a centered position and the plunger bearing 12 urged against the substrate bearings 44, the contact tip 14 rests centered in the opening in the center of the substrate 42, thereby being spaced away from the contacts 46, 48 (described later).

The preferred material for the substrate is a conductor having satisfactory wear properties against the plunger bearing and being springy to absorb repeated loads against the contacts 46, 48. Beryllium copper (BeCu) is a suitable material.

Returning to FIG. 1, the conductive substrate 42 is integral to an insert molded frame 22. The molded frame 22 has an open center portion exposing the substrate bearings 44 and contacts 46, 48 to the plunger bearing 12 and contact tip 14. The molded frame may also have clearance holes 24 to receive electrical components 26 that are electrically connected to the printed circuit board (PCB) 28. With the electrical components 26 fitted inside of the clearance holes 24, the PCB 28 may be secured adjacent to the bottom of the insert molded frame 22, thereby reducing the overall depth of the substrate/PCB assembly. The electrical components may be chosen as needed to implement electrical signals needed by the circuit in which the switch is installed. In one aspect of the invention, the electrical components are resistors, with one being electrically in series with each of contacts 46, 48.

The substrate/PCB assembly is secured within a housing 34. The housing 34 has a pair of yoke pin receivers 38 for receiving yoke pins 20. With the yoke pins 20 secured in the receivers 38, the yoke 16 is pivotable about the yoke pins 20 in the directions show by arrows B—B. The lever pins 4 engage the lever pin receivers 18 formed in the yoke 16, thereby pivotably securing the lever 2 to the yoke 16. The lever 2 is thus pivotable about the lever pins 4 in the directions of arrows A—A. The lever 2 is thereby supported in a gimbal formed by the yoke 16 and housing 34.

Pivoting the lever 2 in either direction A—A and B—B causes the plunger 8 to pivot commensurate with the lever 2. When the plunger 8 is pivoted, the plunger bearing 12 rides up the ramp surface of a substrate bearing 44, thereby further compressing detent spring 6. The additional force in the compressed spring 6 is felt in the lever 2 when it is urged from its neutral, or rest, position. This additional force provides tactile feel in the lever 2.

Pivoting the plunger 8 also causes the contact tip 14 to make contact with contacts 46, 48 integral to the insert molded frame 22. Turning briefly again to FIG. 2*b*, the substrate 42 is shown in clear view along with the contacts 46, 48. The first contact 46 provides an electrical path for a first circuit, and the second contact 48 provides an electrical path for a second, redundant, circuit. When the contact tip 14 is urged into contact with the first and second contacts 46, 48 by pivoting the lever 2, two closed circuits are created. The first closed circuit is between first contact 46, contact tip 14, plunger bearing 12, substrate bearings 44, and substrate 42. The second closed circuit is between second contact 48, contact tip 14, plunger bearing 12, substrate bearings 44, and substrate 42. The contacts 46 and 48 are preferably made of a flexible conductor such as beryllium copper (BeCu).

The interaction between the plunger 8, substrate 42, and contacts 46 and 48 is the same for each pair of contacts, such as third and fourth contacts 68, 70, around the periphery of the substrate 42.

Figure 2A:
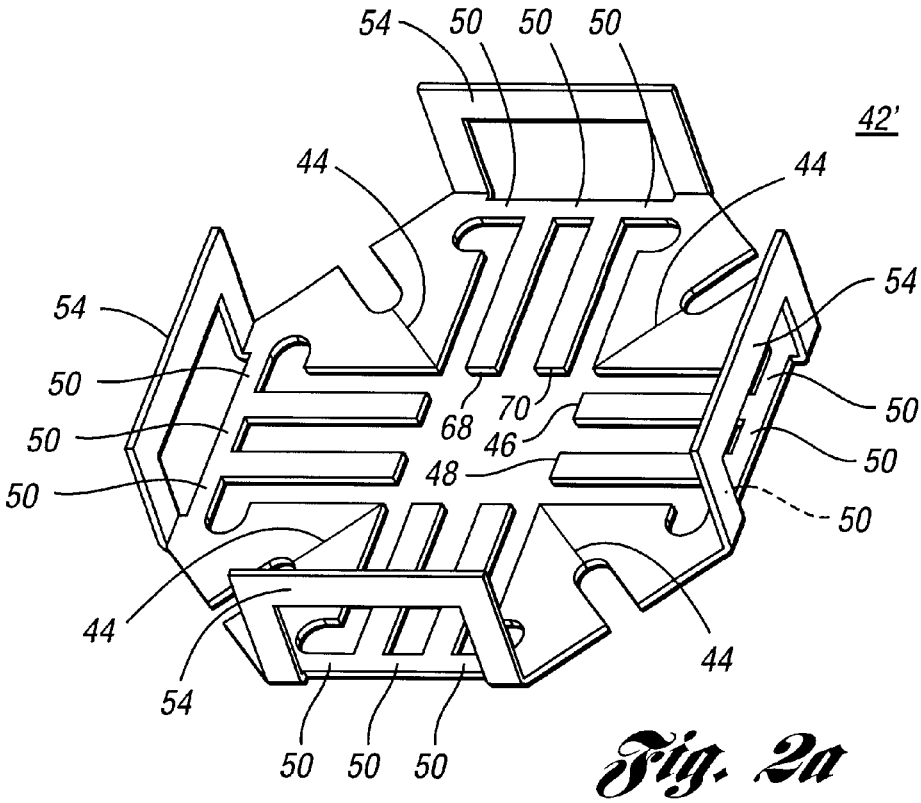
FIG. 2*a* shows a substrate prepared for insert molding.
Figure 2B:
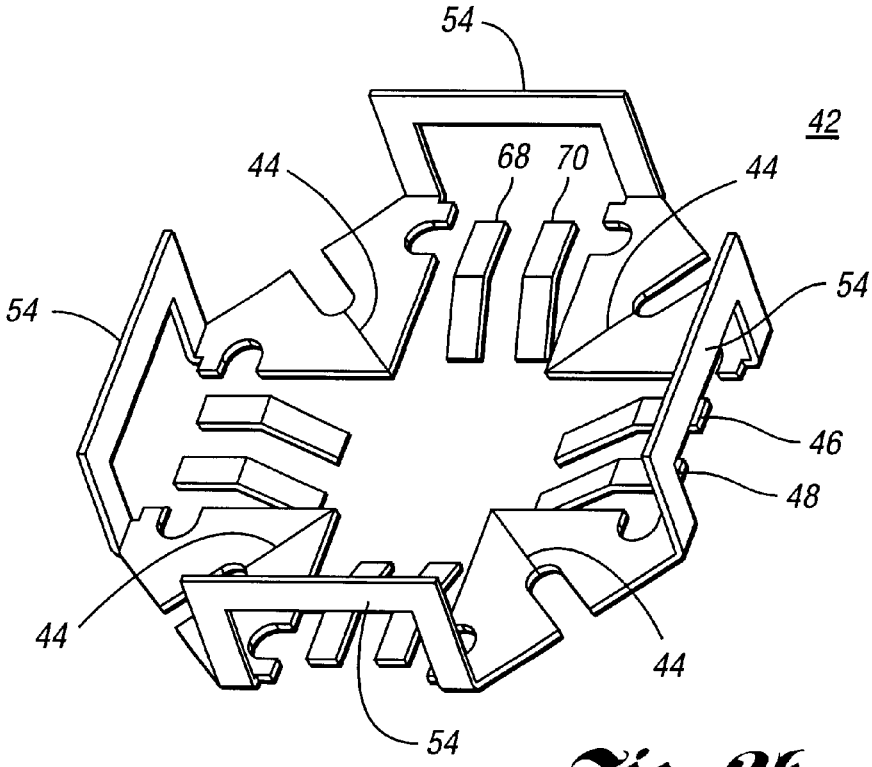
FIG. 2*b* shows a clear view of a substrate with removable portions removed.

Moving to FIG. 2*a*, a substrate 42' is shown prior to being formed and molded into the insert molded frame 22. The substrate 42' is made of conductive material and may have conductive bridges 54. The bridges 54, if used, assure the substrate bearings 44 are at the same electrical potential and together provide a low-impedance electrical connection to the plunger bearing 12. Alternatively, a single substrate bearing could be used as a common electrical contact or, as another alternative, two or more of the substrate bearings could be electrically connected via conductive traces on the PCB 28.

FIG. 2*a* also shows how the first and second contacts 46 and 48 may be formed from a single conductive substrate 42'. The substrate 42' is molded into the insert molded frame 22. Once molded into the frame 22, the removable sections 50 are cut out of the substrate 42'. With the removable sections 50 cut out, the contacts 46 and 48 are electrically isolated from the substrate 42 and retained in position by molded frame 22.

Figure 3:
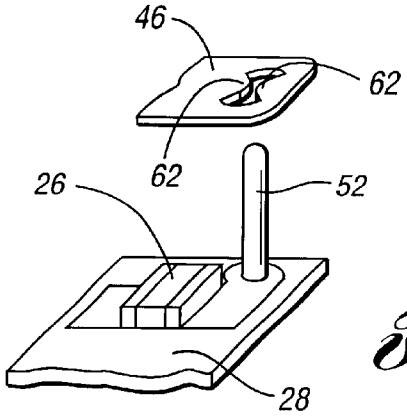
FIG. 3 shows a detailed view of a means for making a connection to the substrate.

Turning to FIG. 3, a means for connecting the PCB 28 to the first contact 46 is shown. This means for connecting may also be used to connect a second contact 48 and substrate 42 to the PCB 28. A pin 52 is connected to the PCB 28 by a conventional method, such as by soldering. The pin 52 stands normal to the plane of the PCB 28 and penetrates an opening in the contact 46. Teeth 62 are integral to the contact 46 and protrude into the opening. As the pin 52 penetrates the opening in a first direction, it displaces the teeth 62 by pushing against them. Once displaced, the teeth 62 are bindingly engaged against the shaft of the pin 52, thereby preventing withdrawal of the pin 52 and also creating an electrical connection between the PCB 28 and contact 46.

Electrical signals may be passed from the PCB 28 to the outside of the housing 34 via connector pins 30. Connector pins 30 are mechanically and electrically connected to the PCB 28 such that when the switch is assembled the pins 30 protrude through the clearance 32 in the housing 34. A connector body 36 may be integrally formed into the housing 34 such that the connector body 36 and pins 30 may be plugged into a wiring harness. Alternatively, a wiring pigtail may be electrically connected to the PCB 28 and extending to the exterior of the housing 34, thereby providing a means of connecting the switch to external circuitry.

Figure 4:
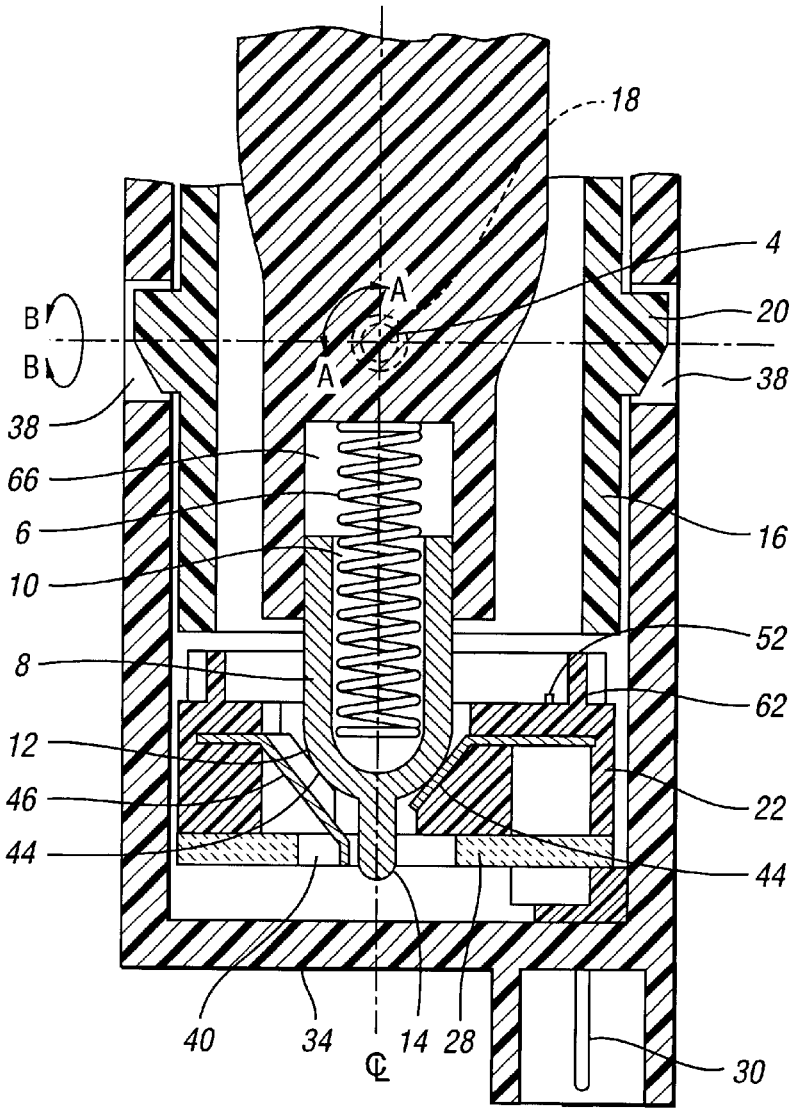
FIG. 4 shows a view of section C—C of FIG. 1.

Moving to FIG. 4, a cross-section is shown taken along the line C—C of FIG. 1. Lever 2 is mounted by lever pins 4 in the gimbal arrangement formed by the yoke 16 and housing 34. The yoke 4 has lever pin receivers 18 for accepting the lever pins 4, and the housing 34 has yoke pin receivers 38 for accepting yoke pins 20. The gimbal thus allows rotation of the lever 2 in the directions shown by arrows A—A and B—B. The plunger 8 is recessed into the plunger receiver 66 such that rotation of lever 2 causes the plunger 8 to rotate therewith. Detent spring 6 urges plunger 8 against substrate bearings 44. When the plunger 8 rotates, the plunger bearing 12 maintains contact with the substrate bearings 44 while the contact tip 14 touches contact 46, thereby creating a closed electrical circuit between the substrate bearing 44 and the contact 46. Current passes through the closed circuit via connector pins 30, the printed circuit board 28, and pins 52. A tactile feel is induced in the lever 2 by the plunger 8 riding up the substrate bearings 44 when the plunger 8 is rotated. The riding-up motion of the plunger 8 causes the detent spring 6 to compress and reflect a tactile feel in lever 2. The range of motion of contact tip 14 is limited by the contacts 46 and 48 and opening 40 in the PCB 28.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrical switch having redundant circuits comprising:

a plunger having an arcuate and conductive plunger bearing and a contact tip, said plunger bearing being electrically connected to said contact tip, a conductive substrate having at least one substrate bearing in electrical contact with and supporting said plunger bearing; and first and second electrical contacts arranged for contacting said contact tip upon said plunger being pivoted from an open position to a closed position, thereby creating a first closed circuit between said substrate and said first contact and a second closed circuit between said substrate and said second contact.

2. The switch of claim 1 further comprising a housing having a cavity and an opening providing access to said cavity, said substrate being secured in said cavity.

3. The switch of claim 2 further comprising a lever having a lever pin and a plunger receiver, said lever pin engaging a lever pin receiver integral to said housing for allowing said lever to pivot about an axis;

a spring receiver formed in said plunger in an end opposite said contact tip, said spring receiver portion of said plunger mating with said plunger receiver; and a spring in compression between said plunger receiver and said spring receiver, said spring urging said plunger bearing against said substrate bearing.

4. The switch of claim 2, said substrate and said first and second contacts being partially molded in a frame.

5. The switch of claim 2, said plunger being made of brass.

6. The switch of claim 2, said substrate being made of berrylium copper.

7. The switch of claim 2, said lever further comprising indicia for indicating a function facilitated by the switch.

8. The switch of claim 1 further comprising a printed circuit board, said printed circuit board being electrically connected to said substrate and said first and second contacts for carrying current flowing through said substrate and said first and second contacts.

9. The switch of claim 8 wherein said printed circuit board further comprises electrical components for affecting current flow through at least one of said substrate, said first contact and said second contact.

10. The switch of claim 8 wherein an opening is formed in said printed circuit board, said contact tip protruding through said opening, the motion of said contact tip being limited by a boundary of said opening.

11. A multi-axis electrical switch having redundant contacts comprising:

a plunger having an arcuate and conductive plunger bearing and a contact tip, said plunger bearing being electrically connected to said contact tip, a conductive substrate having at least one substrate bearing in electrical contact with and supporting said plunger bearing;

first and second electrical contacts arranged for contacting said contact tip upon said plunger being pivoted on a first axis from an open position to a first closed position, thereby creating a first closed circuit between said substrate and said first contact and a second closed circuit between said substrate and said second contact; and third and fourth electrical contacts arranged for contacting said contact tip upon said plunger being pivoted on a second axis from said open position to a second closed position, thereby creating a third closed circuit between said substrate and said third contact and a fourth closed circuit between said substrate and said fourth contact.

12. The switch of claim 11 further comprising a housing having a cavity and an opening to provide access to said cavity, said substrate being secured in said cavity.

13. The switch of claim 12 further comprising a gimbal pivotally mounted to said housing;

a lever mounted in said gimbal, said lever having a plunger receiver;

a spring receiver formed in said plunger in an end opposite said contact tip, said spring receiver portion of said plunger mating with said plunger receiver; and a spring located between said plunger receiver and a surface of said plunger receiver and said spring receiver, said spring urging said plunger bearing against said substrate bearing.

14. The switch of claim 12, said substrate and said first, second, third and fourth contacts being partially molded in a frame.

15. The switch of claim 12, said plunger being made of brass.

16. The switch of claim 12 said substrate being made of berrylium copper.

17. The switch of claim 12, said lever further comprising indicia for indicating a function facilitated by the switch.

18. The switch of claim 11 further comprising a printed circuit board secured to said substrate and at least one of said contacts for carrying current flowing through said substrate and said at least one contact.

19. The switch of claim 18 wherein an opening is formed in said printed circuit board, said contact tip protruding through said opening, the motion of said contact tip being limited by a boundary of said opening.

20. The switch of claim 18 wherein said printed circuit board further comprises electrical components for affecting current flow through at least one of said substrate, and said first, second, third and fourth contacts.

* * * * *